US009754435B2

(12) United States Patent
Razzaboni et al.

(10) Patent No.: US 9,754,435 B2
(45) Date of Patent: Sep. 5, 2017

(54) DEVICE FOR THE INSERTION OF PAPER VALUABLES IN CLOSABLE CONTAINERS, WITH CONTROL AND STORAGE OF VALUABLES ENTERING THE CONTAINER

(71) Applicant: Cima S.p.A., Mirandola (MO) (IT)

(72) Inventors: Nicoletta Razzaboni, Mirandola (IT); Vittorio Razzaboni, Mirandola (IT)

(73) Assignee: CIMA S.P.A., Mirandola (MO) (IT)

( * ) Notice: Subject to any disclaimer, the term of this patent is extended or adjusted under 35 U.S.C. 154(b) by 0 days.

(21) Appl. No.: 14/889,201

(22) PCT Filed: May 27, 2014

(86) PCT No.: PCT/IB2014/061759
§ 371 (c)(1),
(2) Date: Nov. 5, 2015

(87) PCT Pub. No.: WO2014/191922
PCT Pub. Date: Dec. 4, 2014

(65) Prior Publication Data

US 2016/0086415 A1 Mar. 24, 2016

(30) Foreign Application Priority Data

May 28, 2013 (IT) ..... MI2013A0862

(51) Int. Cl.
*G07D 11/00* (2006.01)

(52) U.S. Cl.
CPC ..... *G07D 11/0066* (2013.01); *G07D 11/0069* (2013.01)

(58) Field of Classification Search
CPC ..... G07D 11/0066; G07D 11/0069; G07D 11/0084; G07D 7/20; G07F 19/20; G07F 7/04
USPC ..... 232/1 D, 15, 16, 5; 902/8, 9, 12–15, 17; 235/379; 209/534; 382/137, 138, 140; 194/206
See application file for complete search history.

(56) References Cited

U.S. PATENT DOCUMENTS 5,076,441 A * 12/1991 Gerlier ..... G07D 11/0006 209/534
5,136,144 A * 8/1992 Swinton ..... B65H 29/58 235/379

(Continued)

FOREIGN PATENT DOCUMENTS

EP 0653734 5/1995
EP 1542183 6/2005

OTHER PUBLICATIONS

International Search Report dated Sep. 4, 2014.

*Primary Examiner* — William Miller
(74) *Attorney, Agent, or Firm* — Jacobson Holman, PLLC.

(57) ABSTRACT

A device for the insertion of banknotes into containers in machines suitable for receiving and handling banknotes, comprises a container for the banknotes, adapted to be closed and removed from the machine once filled, and a loading path, diverting from a circulation path inside the machine and ending at said container, for the insertion of banknotes into the container. The device further comprises at least one scanner, placed along the loading path, for the optical detection of images of the banknotes entering into the container and a memory connected to the scanner for storing the images detected thereby.

10 Claims, 3 Drawing Sheets

(56) References Cited

U.S. PATENT DOCUMENTS

Figure 1:
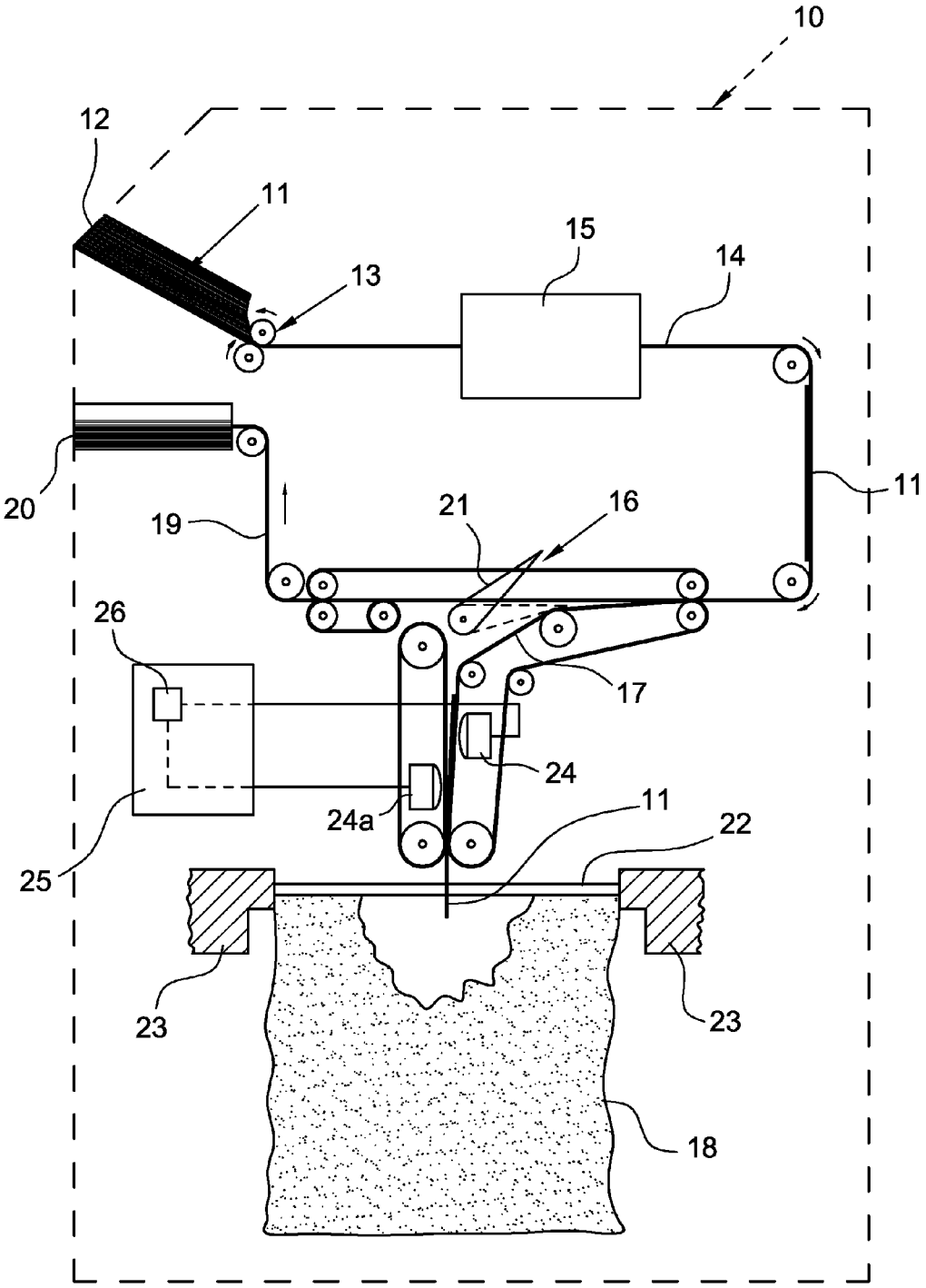

| | | | | |
|---|---|---|---|---|
| 5,673,333 | A * | 9/1997 | Johnston | G07D 11/0096 235/379 |
| 6,636,624 | B2 * | 10/2003 | Raterman | G06Q 20/18 194/207 |
| 6,755,340 | B1 | 6/2004 | Voss et al. | |
| 6,832,723 | B2 * | 12/2004 | Murata | H04N 1/00588 235/439 |
| 7,422,118 | B2 * | 9/2008 | Ugo | B65H 31/24 194/206 |
| 8,939,271 | B2 * | 1/2015 | Petermann | G07D 11/0084 194/206 |
| 2007/0122023 | A1 | 5/2007 | Jenrick et al. | |
| 2011/0130867 | A1 * | 6/2011 | Matsumoto | G07D 11/0051 700/216 |
| 2012/0012437 | A1 * | 1/2012 | Matsumoto | G07D 9/00 194/342 |

* cited by examiner

DEVICE FOR THE INSERTION OF PAPER VALUABLES IN CLOSABLE CONTAINERS, WITH CONTROL AND STORAGE OF VALUABLES ENTERING THE CONTAINER

BACKGROUND OF THE INVENTION

The present invention refers to a device for filling removable containers for paper valuables, for example banknotes, with the possibility of documenting and certifying the contents of the container once it has been filled, closed and removed.

Such device is intended to be used in machines for storing banknotes, usually present in banks, supermarkets, shopping mails or the like.

Herein, reference is made to banknotes, but the same operating principles of the device may be also applied to other paper documents having characteristics similar to those of the banknotes, such as for example cheques, etc.

In the prior art, the banknotes are inserted into these machines through an inlet port, they pass through appropriate counting means and verification and recognition sensors of the characteristics thereof (dimensions, denomination, etc.) and they may be conveyed, if necessary, to temporary storage compartments inside the machine. When required, the banknotes coming directly from the inlet or from the storage compartments inside the machine are inserted in containers, such as boxes or bags removably housed in the machine itself.

After filling, said containers are closed and sealed through known closing means (for example irreversible closing means) adapted to make tampering therewith as difficult as possible or at least clearly recognisable.

After the closure thereof, the containers are then removed from the machine and forwarded to the clients (for example banks or shops) or to suitable storehouses for the storage of valuables.

Regardless of the measures taken for hindering or complicating the fraudulent opening of the containers, tampering actions which are so well executed that they aren't impossible to detect cannot be excluded with certainty.

In addition, it may happen that some errors regarding the detection of the number and characteristics of the passing banknotes occur at the sensors present in the machine (generally before exchanges for the various store compartments) for monitoring the movements of the banknotes. As a matter of fact, such sensors are typically of the ON/OFF operating optical type, i.e. they can "see" or not see the passage of the banknotes depending on the optical parts of the sensor have been obscured or not obscured, and thus it may happen that the passage of two pieces of banknotes, for example caused by tearing of one banknote, is detected as the presence of two banknotes or that two superimposed or partly superimposed banknotes are detected as just one banknote.

It should also be observed that sensors of this type are not capable of recognising and storing specific characteristics of documents that are made to pass through them, for example writings, serial numbers etc.

These drawbacks due to lacking or incomplete detection of the banknotes would not actually be that serious as long as the banknotes remain in the machine given that, for example, with a further control during dispensing, such errors could be detected and corrected suitably.

A criticality occurs instead if an erroneous detection of banknotes intended to be inserted in containers removable from the machine is performed. In fact, it may occur that, due to the possible detection errors described above, the banknotes actually entered into the container are different in terms of number or denomination with respect to what is apparently detected by the sensors present in the machine, with ensuing complaint by the client intended to receive the banknotes.

However, even in cases where such detection errors do not occur and the banknotes entered into the container actually comply with what is detected by the sensors, the container might be tampered during transport, so that the client actually receives an amount smaller than the agreed one, without there being a certification of the exact amount introduced into the container before removal from the machine.

Thus, there has been largely felt the need of how to be able to correctly and provably certify the contents of a removable container for banknotes when it is closed so as to be subsequently removed and sent to destination.

BRIEF SUMMARY OF THE INVENTION

A general object of the present invention is to overcome the aforementioned drawbacks by providing a device for filling removable containers for paper valuables, in particular banknotes, capable of allowing documenting and certifying of the contents of the container once it has been closed and before being removed from the machine in which the filling thereof occurred.

With the aim of attaining such object it was thought of providing, according to the invention, a device for insertion of banknotes into containers in machines suitable for receiving and handling banknotes, comprising a container for the banknotes, adapted to be closed and removed from the machine once filled, and a loading path, diverting from a circulation path inside the machine and ending at said container, for the insertion of banknotes into the container, characterised in that it comprises at least one scanner, placed along the loading path, for the optical detection of images of the banknotes entering into the container and a memory connected to the scanner for storing the images detected thereby.

With the aim of attaining such object it was thought of also providing, according to the invention, a machine for receiving, handling and storing banknotes into containers that can be closed and removed, comprising an inlet, for the banknotes, a path for circulation and conveyance of the banknotes towards the inside of the machine and a device for insertion of the banknotes into the container, said device comprising a container for the banknotes, adapted to be closed and removed from the machine once filled, and a loading path, diverting from said circulation path inside the machine and ending at said container, for insertion of banknotes into the container, characterised in that said device for insertion of the banknotes into the container further comprises at least one scanner, placed along the loading path, for the optical detection of images of banknotes entering into the container and a memory connected to the scanner for storing images detected thereby.

BRIEF DESCRIPTION OF THE SEVERAL VIEWS OF THE DRAWING(S)

Figure 2:
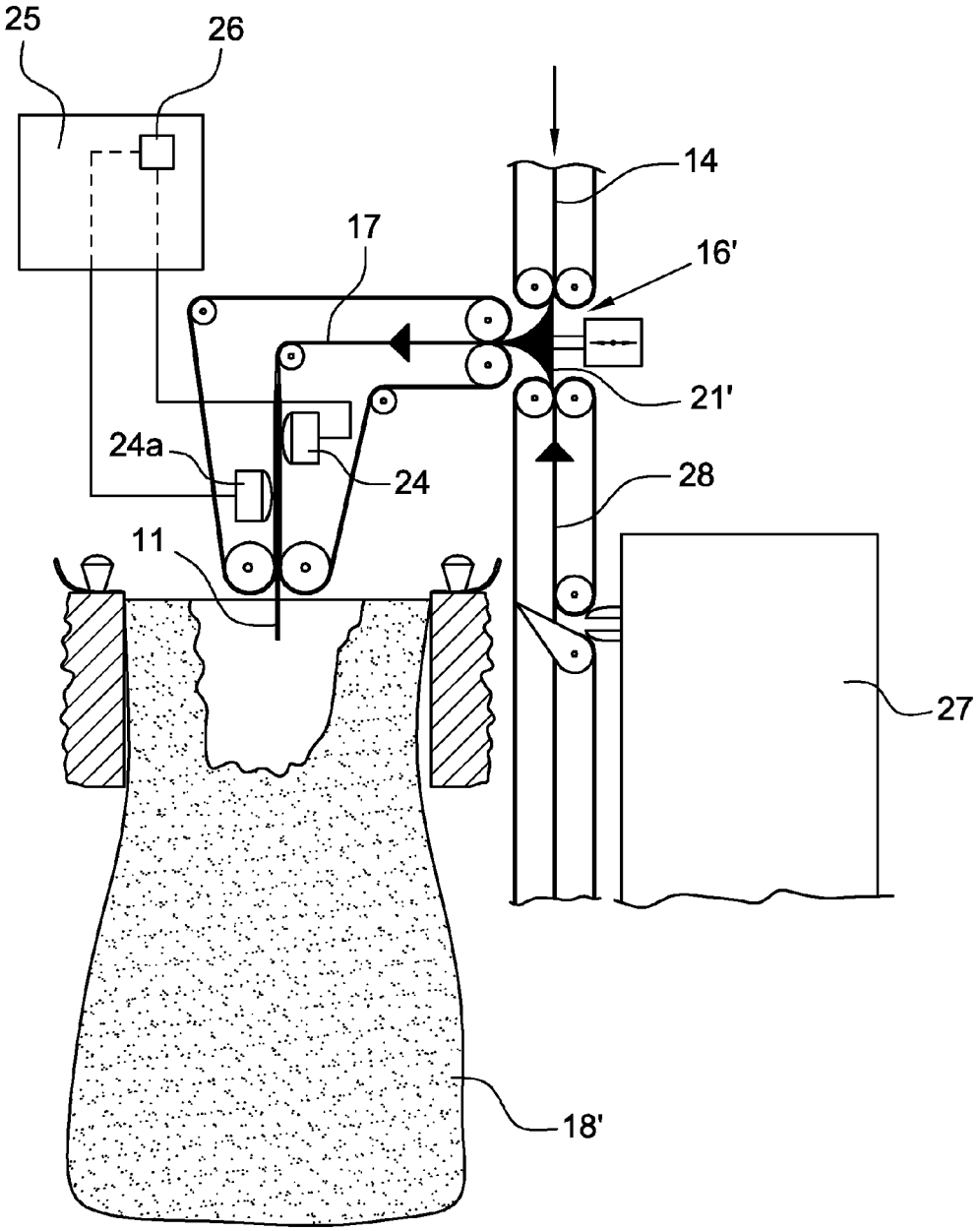
Figure 3:
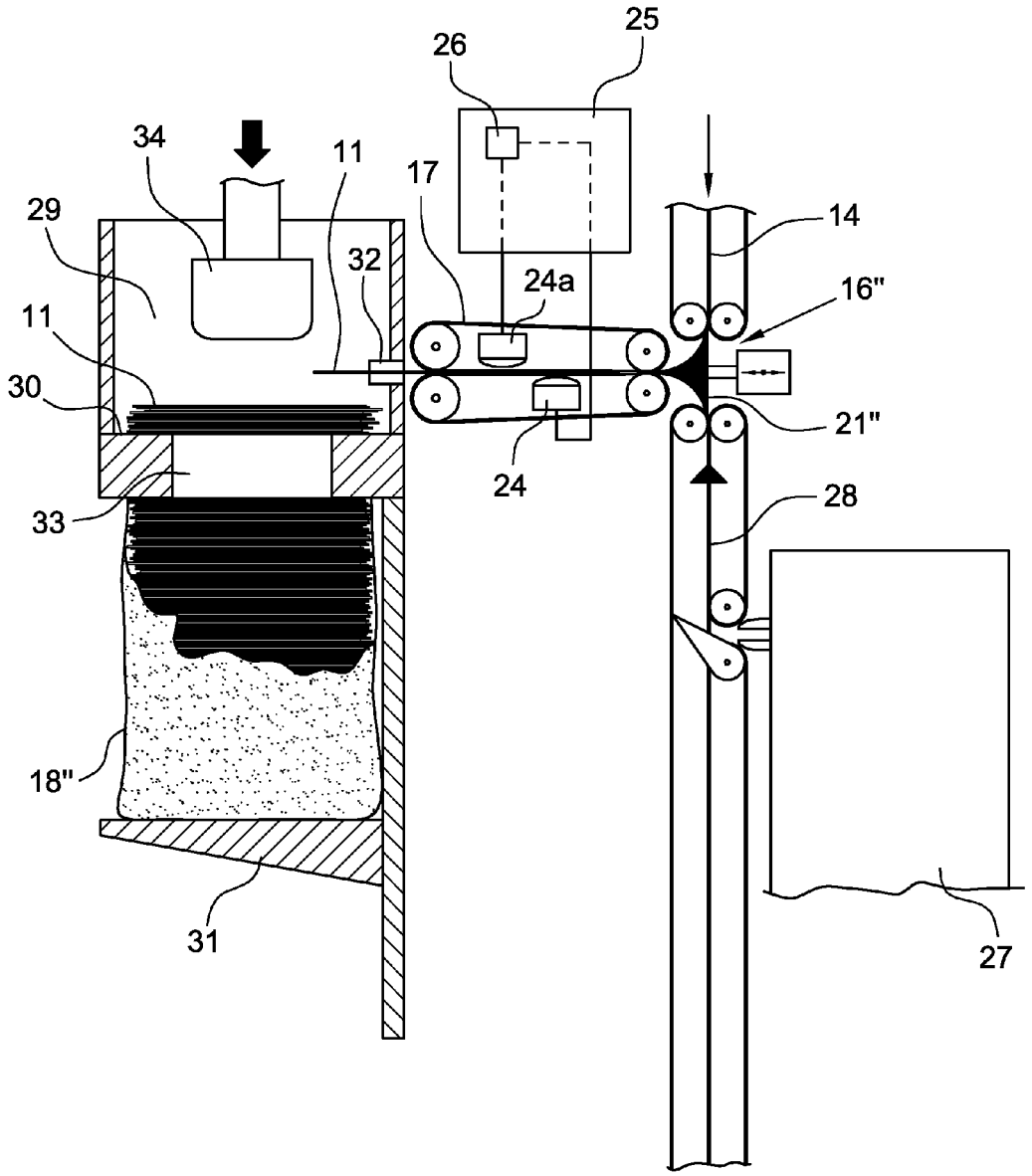

In order to better clarify the explanation of the innovative principles of the present invention and the advantages thereof with respect to the prior art there shall be described hereinafter a. possible embodiment applying such principles with reference to the attached drawings, wherein;

FIG. 1 schematically illustrates a device according to the invention inserted in a machine for receiving and managing paper valuables;

FIG. 2 schematically illustrates a device according to the invention, applied—by way of example—to a machine for receiving, handling and temporary storing of paper valuables;

FIG. 3 schematically illustrates a device like that of FIG. 2, but with a different system for filling the container.

DETAILED DESCRIPTION OF THE INVENTION

FIG. 1 illustrates (in a schematic manner, since it is entirely imaginable by a person skilled in the art) a machine 10 adapted. to receive banknotes 11 through an inlet 12. For the sake of descriptive simplicity reference herein shall be made to banknotes, but is clear that the same operating principles of the device may also apply to other paper documents having characteristics similar to those of the banknotes, such as for example cheques, etc.

For example, the machine may comprise, downstream of the inlet 12, a roller separator 13 suitable for picking single banknotes from the bundle present in the inlet 12 and a path 14 for the circulation and conveyance of the banknotes 11 towards the inside of the machine. Advantageously, the path 14 may consist of conveyor belts, as well known to a person skilled in the art as regards these types of machines.

Along the path 14, immediately downstream of the separator 13, there is normally present a sensor 15 suitable for counting the passing banknotes and, advantageously, also verifying whether they meet predetermined authenticity requirements.

Downstream of the sensor 15 there is present an exchange area 16, suitable to alternatively divert the banknotes 11 towards a loading path 17 for their insertion into a container 18 intended to be removed from the machine once filled, or towards an outlet path 19 directed to a port 20 for the exit from the machine depending on whether the banknotes entering into the machine were verified as suitable or not by the sensor 15. The outlet port 20, may actually be used for discarding the banknotes deemed unsuitable.

The diversion of the banknotes towards the loading path 17 or towards the outlet path 19 may be obtained through an exchange element 21, of the type well known to a person skilled in the art of these machines, which is movable between a position of diversion of the banknotes towards the loading path 17 (represented by a solid line in FIG. 1) and a position of diversion towards the outlet path 19 (represented by a dashed line).

In the machine illustrated in FIG. 1, the container 18 is shown in form of a bag (advantageously of the disposable type which can be closed by sealing the edges of its mouth 22), fixed to the machine through suitable supports 23. FIG. 1 illustrates a system for filling the bag by inserting banknotes thereinto by gravity once the banknotes reach the end of the loading path 17. The bag is represented with its external wall partially removed to show the step of entry of a banknote 11 thereinto.

The device for the insertion of banknotes into the container, intended as an ensemble comprising the loading path 17 and the container 18, also comprises, according to the invention, a scanner 24 for detecting images of the banknotes entering the container and a calculation unit 25, provided with a memory 26 and connected to the scanner 24, for storing the detected images and their subsequent managing.

According to the invention, the scanner 24 is placed in proximity of the end of the loading path 17 in the container 18, and however downstream of the switch 21 for diversion from the internal circulation path 14. In fact, given that the exchange constitutes a criticality point in which jamming of banknotes may occur relatively easily, or even failure to divert towards the correct path, the arrangement of the scanner downstream thereof allows to detect the actual images of all and just the banknotes that actually enter into the container 18.

Thus, due to the detection and storage of the images of the banknotes passing along the loading path 17 and entering into the container 18, it is possible to build a visual archive of the banknotes actually introduced into the container (with all their characteristics, such as value, inscriptions, serial number, etc.) and certify the exact content of the bag at the moment of closure and removal thereof from the machine. Thus, with each filled and sealed container there may be associated not only the indication of the number and value of the banknotes, but also a sequence of images certifying the exact content.

Advantageously, there may be used a scanner of the CIS (Contact Image Sensor) type, which has particularly small dimensions and it is capable of also detecting further physical characteristics of the passing document, such as for example the ultraviolet or infrared printing, as to allow obtaining and memorising different types of images. Actually, the term image is herein used to indicate a generic visual representation of the document passing through the scanner, through which the document itself can he identified and recognised unambiguously.

In the example illustrated in the figures two scanners 24, **24*a* are in particular present, each of which faces one of the two faces of the passing banknote, so as to detect a complete image of the same. Advantageously, the two scanners 24, 24*a*** are arranged offset along the path of the banknotes so as to avoid mutual interference.

However, depending on the specific needs, there may also be provided only one scanner so as to perform the scanning of only one side of the banknotes.

Naturally, with the aim of allowing the detection of the images of the banknotes by the scanners, the person skilled in the art may provide for suitable solutions, easily imaginable for him, which make the surface of the banknote directly visible by the sensor. For example, there might be provided for a physical interruption of the belt, or a diversion thereof, at the scanner. A possible solution, if deemed appropriate by the person skilled in the art, could also be that of using conveyor belts made of transparent film, at least in the section subject of scanning.

FIG. 2 illustrates a device conceptually, structurally and functionally analogous to that of FIG. 1, but placed in a machine also provided with storage compartments 27 (only one of which, for the sake of simplicity, is shown in the figure) for the temporary housing of the banknotes awaiting to be conveyed to the filling container 18'. For this purpose, suitable transport paths 28 may be provided for connecting the storage compartments 27 with the path 14 for the circulation and conveyance of the banknotes towards the internal of the machine and with the loading path 17 for the insertion thereof in the container 18'.

Analogous elements, or elements corresponding to those of FIG. 1 are indicated in FIG. 2 with the same reference number.

An exchange area 16', provided with an appropriate mobile exchange element 21', is present at the intersection of the paths for the movement of the banknotes to selectively guide the banknotes from/to the storage compartments 27 and towards the container 18'.

In the arrangement of FIG. 2 even the container 18' is a bag of the type to be filled by gravity like that of FIG. 1, i.e. suitable for drop-receiving the banknotes 11 when the latter reach the end of the loading path 17.

Also in this case, downstream of the switch 21' for diversion from the internal circulation path 14 and from the path 28 for connection with the storage compartments 27, and advantageously in proximity of the end of the loading path 17, there is present a scanner 24 for the detection of images of the banknotes entering the container. Possibly, there may also be present a second scanner 24*a*, so that each scanner faces one of the two faces of the passing banknote. The scanner 24 (same case applying to the possible second scanner 24*a*) is connected to a memory 26 of a calculation unit 25 for storing the detected images and the subsequent managing thereof.

FIG. 3 shows a device conceptually, structurally and functionally analogous to that of FIG. 2, still placed in a machine provided with storage compartments 27 for the temporary housing of the banknotes awaiting to be conveyed to the filling container 18". Analogous elements, or elements corresponding to those of FIG. 2 are indicated with the same reference number. Thus, also in this case, there are appropriate transport paths 28 for connecting the storage compartments 27 with the path 14 for the circulation and conveyance of the banknotes towards the internal of the machine and with the loading path 17 for the insertion thereof into the container 18".

An exchange area 16", provided with an appropriate mobile exchange element 21", is present at the intersection of the paths for movement of the banknotes to selectively guide the banknotes from/to the storage compartments 27 and towards the container 18".

In the arrangement of FIG. 3 at the end of the loading path 17, at the inlet of the container 18", there is present a compartment 29 for the temporary housing, on a bottom thereof 30, of the banknotes 11 awaiting their insertion into the container 18" and the container itself is placed below the compartment 29, supported by a vertically mobile plate 31, advantageously against the action of thrust springs not shown in the figure.

More in particular, the compartment 29 is provided with a port 32 for the inlet of the banknotes coming from the loading path 17 up to forming a stack of banknotes (as observable in the figure) and an opening 33 in the bottom 30 thereof for the insertion of banknotes in the bag 18" pushed by a piston movable vertically in the compartment 29.

As the banknotes progressively enter into the bag 18", their weight causes a lowering of the plate 31, thus facilitating the extension of the bag and the optimal filling thereof.

Even in this case, downstream of the switch 21" for diversion from the internal circulation path 14 and from the path 28 for connection with the storage compartments 27, and advantageously in proximity of the end of the loading path 17, there is present a scanner 24 for the detection of images of the banknotes entering the container. Possibly, there may also be present a second scanner 24*a*, so that each scanner faces one of the two faces of the passing banknote. The scanner 24 (same case applying to the possible second scanner 24*a*) is connected to a memory 26 of a calculation unit 25 for storing the detected images and the subsequent managing thereof.

At this point, it is clear that according to the invention, it is possible to obtain a device for the filling of removable containers for paper valuables, in particular banknotes, capable of allowing documenting and certifying the contents of the container once it has been closed and before being removed from the machine in which the filling thereof took place.

Naturally, the description outlined above regarding an embodiment applying the innovative principles of the present invention, is provided by way of examples of such innovative principles and thus shall not be deemed to be limiting within the scope of the patent claimed herein.

For example, the container for the banknotes may also be in form of rigid box, instead of flexible bag. In addition, the way of filling the container may be adapted from time to time to the specific requirements.

The invention claimed is:

1. A device for insertion of banknotes into containers, adapted to be used inside machines suitable for receiving and handling banknotes, comprising a container for the banknotes, adapted to be closed and removed from the machine once filled, and a loading path diverting, through an exchange element, from a circulation path inside the machine and ending at said container, for the insertion of banknotes into the container, wherein the device further comprises at least one scanner, placed along the loading path downstream of said exchange element and in proximity of the end of the loading path into the container, for the optical detection of images of the banknotes entering into the container and a calculation unit provided with a memory and connected to the scanner for storing the images detected thereby and building a visual archive of the banknotes actually introduced into the container for certification of the exact content of the container.

2. The device according to claim 1, wherein the at least one scanner comprises two scanners, each of which faces one of two faces of the banknote passing along the loading path.

3. The device according to claim 2, wherein the two scanners are arranged offset along the loading path.

4. The device according to claim 1, wherein the scanner is a contact image sensor.

5. The device according to claim 1, wherein the memory is connected to the calculation unit for managing the stored images.

6. A machine for receiving, handling and storing banknotes into containers that can be closed and removed, comprising an inlet for the banknotes, a path for circulation and conveyance of the banknotes towards the inside of the machine and a device for insertion of the banknotes into the container, said device comprising the container for the banknotes, adapted to be closed and removed from the machine once filled, and a loading path diverting, through an exchange element, from said circulation path inside the machine and ending at said container, wherein said device for insertion of the banknotes into the container further comprises at least one scanner, placed along the loading path downstream of said exchange element and in proximity of the end of the loading path into the container, for the optical detection of images of banknotes entering into the container and a calculation unit provided with a memory and connected to the scanner for storing images detected thereby and building a visual archive of the banknotes actually introduced into the container for certification of the exact content of the container.

7. The machine according to claim 6, wherein the at least one scanner comprises two scanners, each of which faces one of the two faces of the banknote passing along the loading path.

8. The machine according to claim 7, wherein the two scanners are arranged offset along the loading path.

9. The machine according to claim 6, wherein the scanner is a contact image sensor.

10. A machine for receiving, handling and storing banknotes into containers that can be closed and removed, comprising an inlet for the banknotes, a path for circulation and conveyance of the banknotes towards the inside of the machine and a device for insertion of the banknotes into the container, said device comprising the container for the banknotes, adapted to be closed and removed from the machine once filled, and a loading path, diverting from said circulation path inside the machine and ending at said container, wherein said device for insertion of the banknotes into the container further comprises at least one scanner, placed along the loading path, for the optical detection of images of banknotes entering into the container and a memory connected to the scanner for storing images detected thereby, wherein the scanner is placed along the loading path downstream of an exchange element suitable for diverting the banknotes from the circulation path inside the machine towards the loading path, and wherein the machine further comprises at least one storing compartment for temporary housing of banknotes awaiting to be conveyed to the container, said exchange element being adapted to selectively divert the banknotes from the circulation path inside the machine or from paths for connection with the at least one storing compartment towards the loading path.

* * * * *